US007874046B2

(12) United States Patent
Leinders et al.

(10) Patent No.: US 7,874,046 B2
(45) Date of Patent: Jan. 25, 2011

(54) APPARATUS ON A SPINNING PREPARATION MACHINE FOR MONITORING AND/OR ADJUSTING CLEARANCES AT COMPONENTS

(75) Inventors: Christoph Leinders, Korschenbroich (DE); Dieter Wirtz, Erkelenz (DE); Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1042 days.

(21) Appl. No.: 11/655,233

(22) Filed: Jan. 19, 2007

(65) Prior Publication Data

US 2007/0163086 A1 Jul. 19, 2007

(30) Foreign Application Priority Data

Jan. 19, 2006 (DE) ..... 10 2006 002 812
Dec. 8, 2006 (DE) ..... 10 2006 058 274

(51) Int. Cl.
*D01H 5/32* (2006.01)

(52) U.S. Cl. ..... 19/240

(58) Field of Classification Search ..... 19/236–240, 19/250, 258, 98, 105, 300, 150, 157
See application file for complete search history.

(56) References Cited

U.S. PATENT DOCUMENTS 5,010,494 A * 4/1991 Lord ..... 702/35
5,606,509 A * 2/1997 Denz et al. ..... 700/143
5,713,106 A * 2/1998 Dammig ..... 19/240
5,796,635 A * 8/1998 Dammig ..... 702/170

FOREIGN PATENT DOCUMENTS

| | | | |
|---|---|---|---|
| DE | 2 29 595 | A | 5/1909 |
| DE | 39 13 996 | A1 | 8/1990 |
| DE | 42 35 610 | C2 | 4/1996 |
| DE | 100 53 139 | A1 | 5/2000 |
| GB | 2368351 | A | 1/2002 |
| WO | WO2006/119655 | A1 | 11/2006 |
| WO | WO2006/119658 | A1 | 11/2006 |

OTHER PUBLICATIONS

German Search Report dated Jul. 12, 2006, issued in DE 10 2006 002 812.0.
United Kingdom Patent Office Action, dated May 4, 2007, issued for corresponding Great Britain Application No. 0700817.0 (and partial English translation).

* cited by examiner

*Primary Examiner*—Tejash Patel
(74) *Attorney, Agent, or Firm*—Venable LLP; Robert Kinberg; Justine A. Gozzi

(57) ABSTRACT

An apparatus on a spinning preparation machine for monitoring and/or adjusting clearances at components has a clothed, high-speed roller located facing at least one clothed and/or unclothed component and the clearance between the components facing one another is alterable. The roller and opposed component(s) are electrically isolated with respect to one another and are connected as contact elements to an electrical power supply line in which a measuring device for ascertaining contact is located. In order to avoid an undesirably heavy contact between the components, electric signals are emitted upon contacts with the clothing of the roller and the measuring device is arranged quantitatively to determine the contacts.

25 Claims, 7 Drawing Sheets

APPARATUS ON A SPINNING PREPARATION MACHINE FOR MONITORING AND/OR ADJUSTING CLEARANCES AT COMPONENTS

CROSS REFERENCE TO RELATED APPLICATION

This application claims priority of German Patent Application No. 10 2006 002 812.0 dated Jan. 19, 2006, and German Patent of Addition Application No. 10 2006 058 274.8 dated Dec. 8, 2006, the entire disclosure of which are incorporated herein by reference.

BACKGROUND OF THE INVENTION

The invention relates to an apparatus on a spinning preparation machine, especially but not exclusively a flat card, roller card or similar, for monitoring and/or adjusting clearances at components.

When cleaning or carding the fibre material, for example, cotton and/or synthetic fibres, stationary cleaning or carding elements are normally placed facing a rotating roller fitted with clothing. To achieve a good cleaning and/or carding action, these elements must be arranged as close as possible to the clothing of the rotating roller. Adjustment is effected in the cold state or with the roller stationary. Owing to the heat generated in operation and owing to the roller expansion caused by centrifugal force during rotation, the clearance between the roller and the cleaning or carding elements diminishes. In the process, if the adjustment was not effected according to specifications, it may happen that these elements touch the roller during operation. This contact often leads to further heating and to an associated contact pressure on the clothing, with the result that this may "burst". This is associated with considerable consequential damage.

In consequence of misadjustments or incorrect machine operation, carding machines may crash. The repair costs for such crashes are substantial. Contact between a stationary component and, for example, a carding cylinder, has destructive consequences, because due to the setting of its abrasive teeth the roller clothing exerts a strong pulling action on components on contact therewith, and when contact is discovered, for example, by an operator, the rollers take at least five minutes to run down to a standstill. Damage escalates during this time.

The effective clearance of the tips of a clothing from a machine element facing the clothing is called the carding gap. The last-mentioned element can also have a clothing, but could instead be formed by a casing element having a guide surface. The carding gap is crucial for the carding quality. The size (width) of the carding gap is an important machine parameter, which shapes both the technology (the fibre processing) and the running performance of the machine. The carding gap is set to be as narrow as possible (it is measured in tenths of a millimeter), without running the risk of a "collision" between the work elements. To ensure a uniform processing of the fibres, the gap must be as uniform as possible over the entire working width of the machine.

The carding gap is influenced in particular by the machine settings on the one hand and by the condition of the clothing on the other hand. The most important carding gap of the revolving flat card is located in the main carding zone, i.e. between the cylinder and the revolving flat assembly. At least one clothing, which adjoins the working distance, is in motion, more often than not both clothings. In order to increase the production of the card, it is endeavoured to select the operating revolution speed or the operating speed of the moving elements to be as high as the technology of fibre processing allows. The operating state alters in dependence on the operating conditions. The change is effected in the radial direction (starting from the axis of rotation) of the cylinder.

During carding, increasingly larger amounts of fibre material per unit of time are processed, which means higher speeds of the work elements and higher installed power capacities. Increasing volumetric flow rate of fibre material (output), even with a working area that remains constant, leads to increased generation of heat due to the mechanical work. But at the same time the technological carding result (sliver uniformity, degree of cleaning, reduction in neps etc.) is continuously improved, which involves more active surfaces in carding engagement and closer settings of these active surfaces with respect to the cylinder (tambour). The proportion of synthetic fibres to be processed is steadily increasing, and in this case—compared with cotton—through contact with the active surfaces of the machine more heat is generated by friction. The work elements of high-performance cards are nowadays fully enclosed on all sides, in order to comply with high safety standards, to prevent particle emission into the spinning room environment and to minimise required maintenance of the machines. Grids or even open, material-guiding surfaces that permit air exchange, belong to the past. The conditions mentioned clearly increase the input of heat into the machine, whilst the discharge of heat by means of convection clearly decreases. The resultant greater heating of high-performance cards leads to greater thermoelastic deformations, which, owing to the non-uniform distribution of the temperature field, influence the set clearances of the active surfaces: the clearances between cylinder and card top, doffer, fixed card tops and separation points with blades decrease. In an extreme case, the space set between the active surfaces can be completely absorbed by thermal expansions, so that components moving relative to one another collide. The result is major damage to the high-performance card in question. Moreover, in particular the generation of heat in the working region of the card can lead to different thermal expansions in the case of unduly large temperature differences between the components.

To reduce or avoid the risk of collisions, in practical operation the carding gap between clothings facing one another is set to be relatively wide, i.e. a certain safety clearance exists. A large carding gap, however, leads to undesirable nep formation in the card sliver. In contrast, an optimum, especially narrow size is desirable, whereby the nep count in the card sliver is substantially reduced.

In one known arrangement, a clothed, high-speed roller is located facing at least one clothed and/or unclothed component and the clearance between the components facing one another is alterable, the components arranged with a clearance being electrically isolated with respect to one another and being connected as contact elements to an electrical power supply line, in which a measuring element for ascertaining contact is located. In DE-PS 229 595, in the case of a roller card where clearance between the card wire elements is to be monitored, in accordance with a first embodiment of the publication it is known to connect the card wire covering of each element as contact to an electrical power supply line, in which there is a signalling or alarm device. According to a second embodiment, contact rockers are present, which are connected to the electrical power supply line as contacts. It is a disadvantage that even upon a single touching (contact) merely between two facing tips the circuit is closed and the signalling or alarm device takes effect. It may also happen that an electrically conductive particle is circulating with the fibre material, which leads to a spurious shutdown through point contact touch. At the high circumferential speeds and centrifugal moments of the clothed rollers, individual protruding tooth tips or small conductive particles are in practice, however, ground off after such a signal. The known apparatus allows only the mere detection of contact.

SUMMARY OF THE INVENTION

It is an aim of the invention to produce an apparatus of the kind described initially, which avoids or mitigates the said disadvantages and which in particular in a simple manner avoids an undesirable heavy contact between the components, primarily damage to a clothing, when facing components approach one another.

The invention provides an apparatus on a spinning preparation machine, comprising a clothed roller and a machine component opposed to the clothed roller and defining therewith a clearance at which contact between the roller and opposed component is to be monitored, wherein:

said clothed roller and said machine component are electrically isolated with respect to one another at said clearance during normal operation;

said clothed roller and said machine component are connected as contact elements to an electrical circuit; and said electrical circuit includes a measuring device for quantitatively measuring the contacts.

By means of the measures according to the invention, a quantitative determination of the contacts is carried out, whereby a signal or response is avoided if there is only one or only slight contact. In particular, there is avoided an undesirable shutdown of the machine, which in continuous operation occurs in the known apparatus mentioned above owing to sporadic contacts between the work elements caused, for example, by conductive particles in the fibre material. Since these contactings only occur sporadically, they can be filtered by evaluating the number of contacts in a contact period. It is thus possible to differentiate between these contact states, for example, by means of the machine control, and to avoid damage to the clothing.

In one preferred embodiment, the output of the device for determining the quantity of the contacts is connected via a comparator to at least one limit value setter and to a signalling and/or switching device. By means of those measures, the quantity of measured values is advantageously compared with a limit value and when the limit value is exceeded a signal and/or a switching operation is initiated. The limit value is advantageously chosen so that it is not reached when individual or slight contact occurs. Exceeding the limit value, on the other hand, initiates the signalling and/or switching operation. In this way, when facing components approach one another, an undesirably heavy contact between the components is reliably avoided.

The quantity of the contacts may be determinable directly or indirectly. In a preferred embodiment, at least the number of contacts is determinable. In that case, a counting device is advantageously present for counting the number of contacts. As well, or instead, the duration and/or intensity of the contacts may be determinable. For example, a resistance-measuring device for determining the intensity of the contacts may be present. Advantageously, the amount, especially the number, of the contacts per unit of time is determinable. The components facing one another, for example, clothings may be electrically connected to the device for quantitatively determining the contacts. In certain preferred embodiments, the device for quantitatively determining the contacts comprises a comparator. Where present, the comparator is advantageously connected to a limit value setter and/or to an electronic control and regulating device, for example, a machine control.

In a preferred embodiment, two metal clothings facing one another are electrically conductive components of the electrical circuit. In that case, a lead is advantageously connected to each electrically conductive clothing. Advantageously, an electrical signal is generated upon a contact between the roller and a facing component. The electrical signals are advantageously evaluated by a device, which may in certain advantageous embodiments be a control device for the machine. The apparatus according to the invention is advantageously connected to one or more devices selected from a signalling device, an alarm device, and a shutdown device for the card. In one preferred embodiment, the apparatus according to the invention is connected to an adjusting device for the clearance, for example, for a carding gap between the roller and an opposed component.

The opposed component with which the clothed roller forms a clearance to be monitored may be a clothed component or a non-clothed component, but is preferred to be a clothed component. It may be a stationary component, or a moving component, for example, a revolving card flat.

The invention includes arrangements in which clearances at more than one machine component can be monitored, in which the clearances can be at the same or different clothed rollers.

The invention also provides an apparatus on a spinning preparation machine, especially a flat card, roller card or similar, for monitoring and/or adjusting clearances at components, in which a clothed, high-speed roller is located facing at least one clothed and/or unclothed component and the clearance between the components facing one another is alterable, wherein the components arranged with a clearance are electrically isolated with respect to one another and are connected as contact elements to an electrical power supply line in which a measuring device for ascertaining contact is located, wherein upon contacts with the clothing of the roller electrical signals are emitted and the measuring device includes a device for determining the quantity of the contacts.

In a further advantageous embodiment of the invention, the electrical capacitance between the components facing one another is determinable and, on departure from a desired capacitance, a signal is generated for an adjustment process or a switching-off process. By means of measuring the capacitance and comparing it with a desired value, the operative state of the electrical circuit can be checked. That is particularly advantageous in that it allows self-testing to be achieved. That prevents, especially, the ceasing of detection of the contacts in the event of an undesirable interruption of the electrical circuit, which can lead to substantial damage up to complete breakdown of the machine.

DETAILED DESCRIPTION OF PREFERRED EMBODIMENTS

Figure 1:
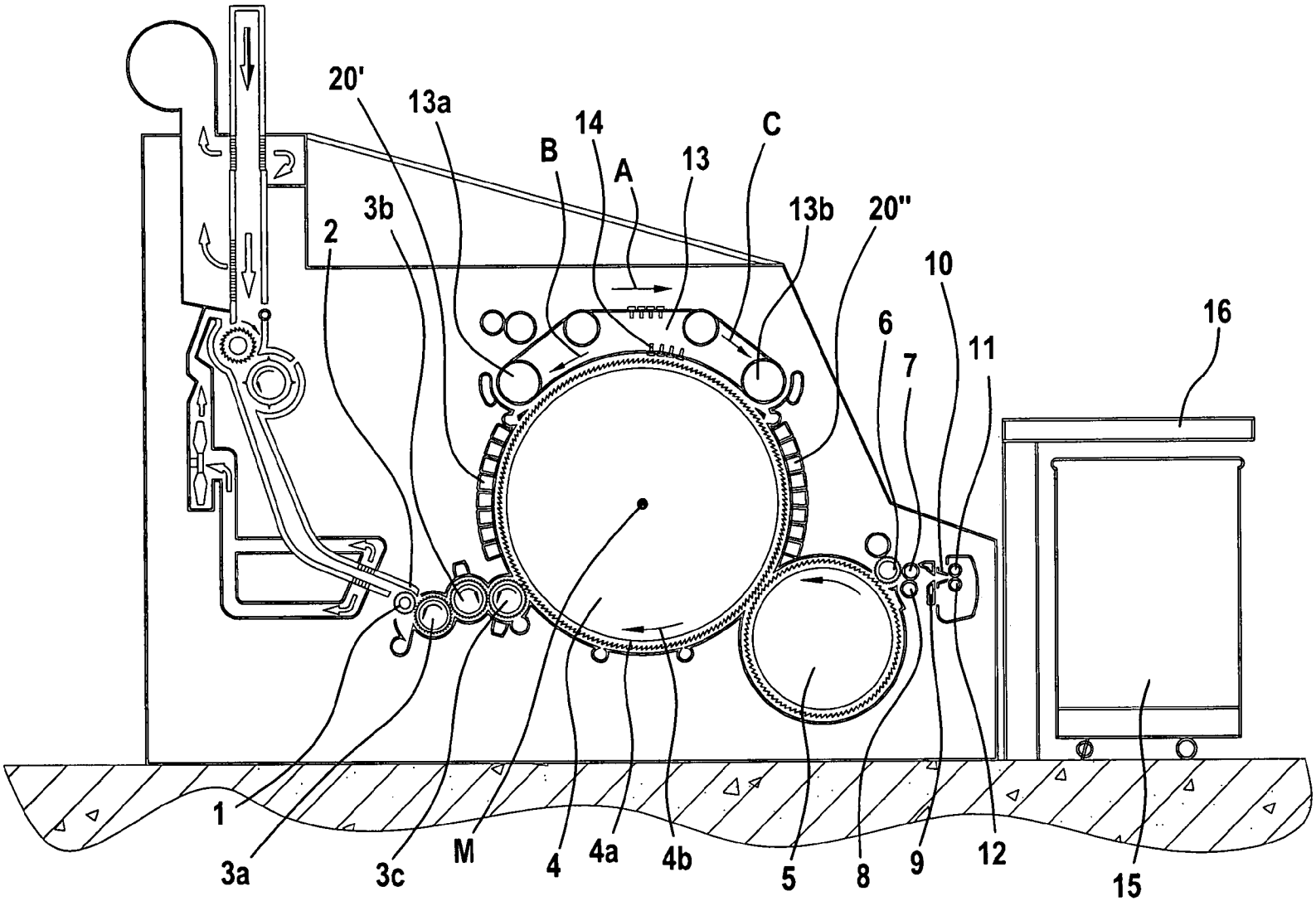
FIG. 1 is a schematic side view of a card which may have an apparatus according to the invention.

Referring to FIG. 1, a flat card for example, a flat card TC 03 (Trade Mark) made by Trützschler GmbH & Co. KG. of Monchengladbach, Germany, has feed roller 1, feed table 2, licker-ins 3*a*, 3*b*, 3*c*, cylinder 4, doffer 5, stripping roller 6, squeezing rollers 7, 8, web deflector 9, web funnel 10, take-off rollers 11, 12, revolving flat 13 with flat guide rollers 13*a*, 13*b* and flat bars 14, can 15 and can coiler 16. The directions of rotation of the rollers are shown by respective curved arrows. The letter M denotes the midpoint (axis) of the cylinder 4. The reference numeral 4*a* denotes the clothing and 4*b* denotes the direction of rotation of the numeral 4*a* denotes the clothing and 4*b* denotes the direction of rotation of the cylinder 4. The arrows A, B, and C denote the working direction. The curved arrows drawn in the rollers denote the directions of rotation of the rollers. In an illustrative embodiment of the invention described below, an apparatus according to the invention is provided at one or more of the stationary carding segments 20' and 20". Instead, or as well, other work elements and/or casing elements may be provided with an apparatus according to the invention.

Figure 2:
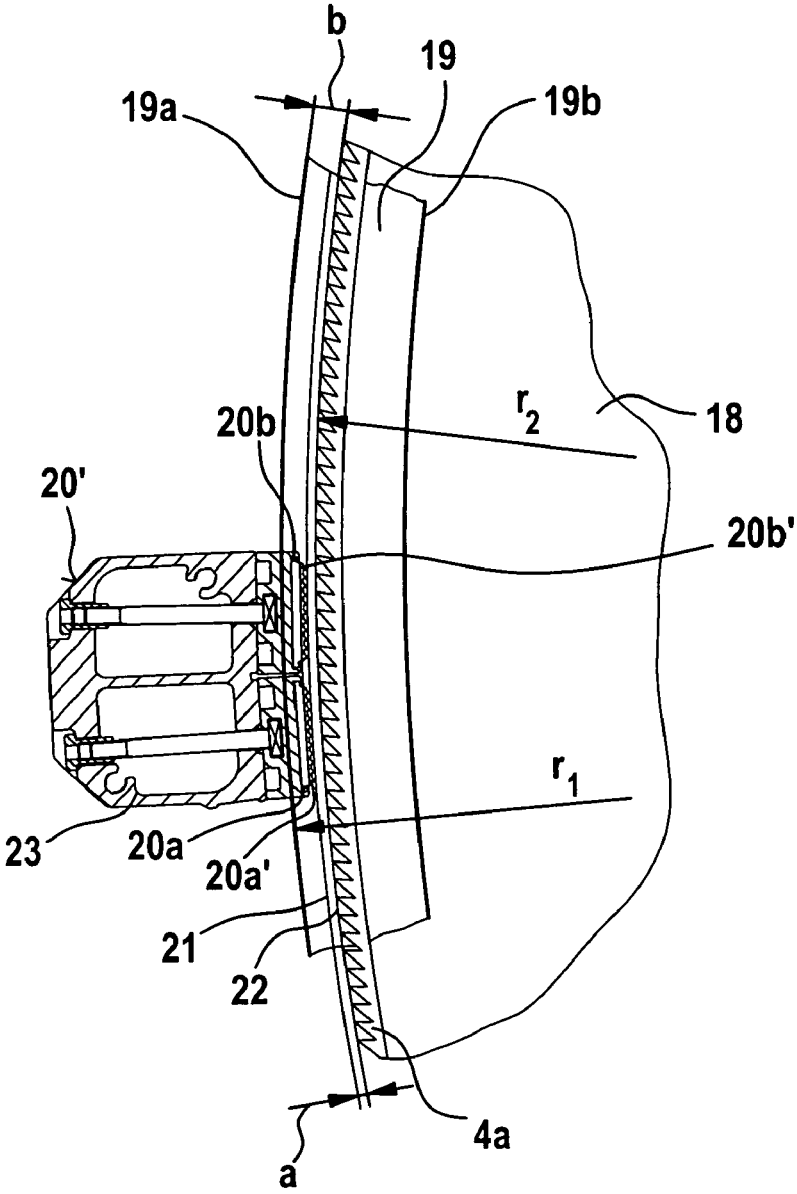
FIG. 2 is an enlarged view, partly in section, of a part of the card of FIG. 1, showing a carding segment, a fragment of a side plate with a clearance between the carding segment clothing and the cylinder clothing, which may form part of one embodiment of the invention.
Figure 2A:
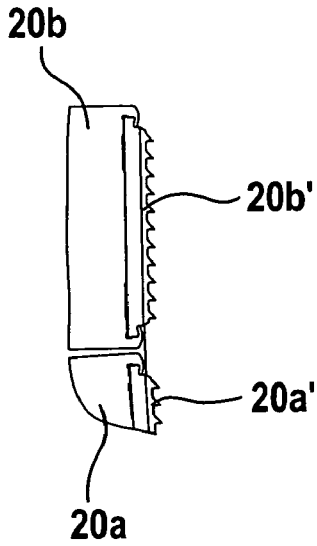
FIG. 2*a* shows carding elements of the carding segment as shown in FIG. 2 in detail.
Figure 3:
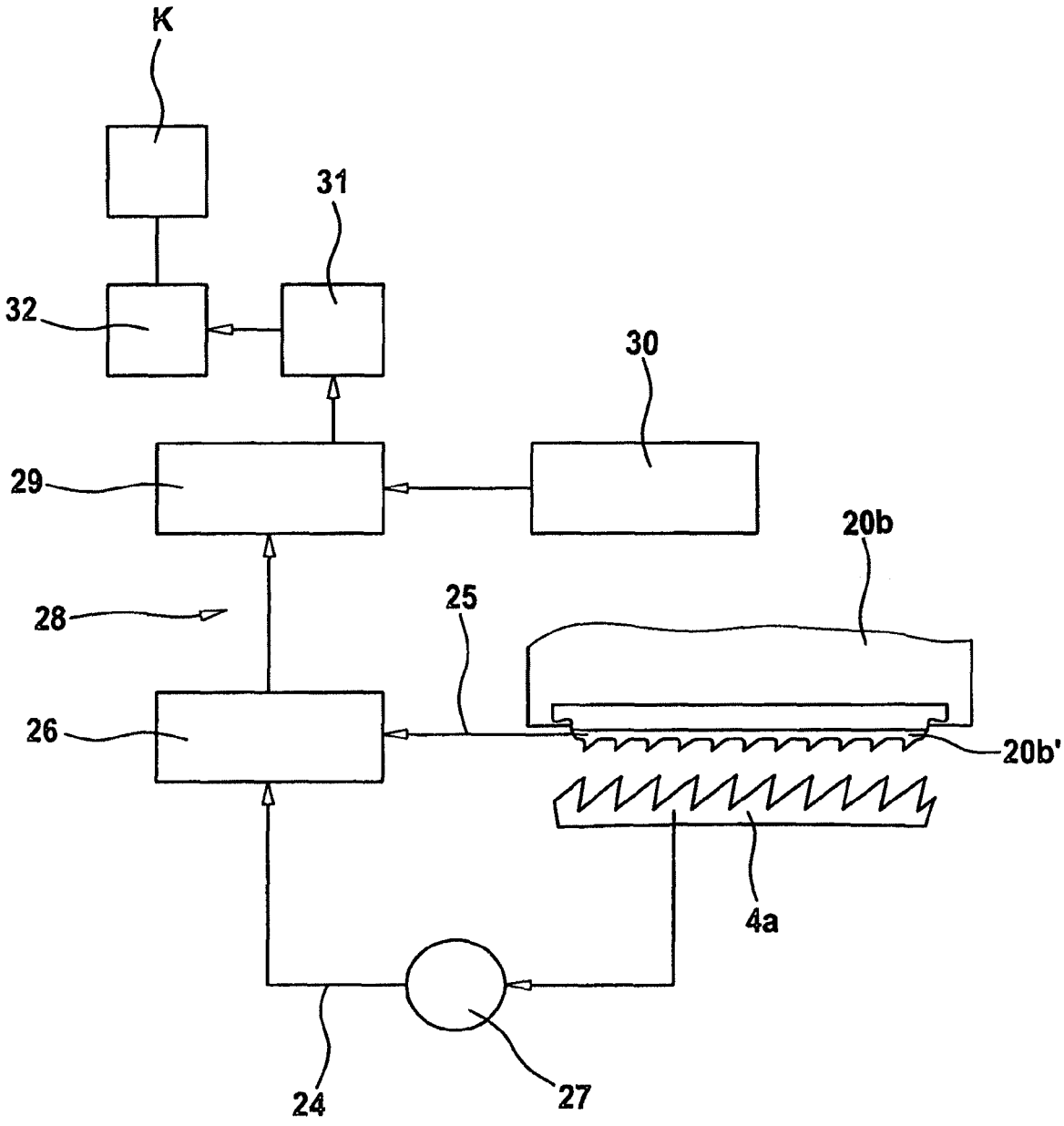
FIG. 3 is a block diagram with counting device, comparator, limit value setter and electronic control and regulating arrangement (machine control) according to one embodiment of the invention.

In the illustrative embodiment of FIGS. 2 and 3, contacts between the cylinder 4 and stationary carding segment 20' are monitored. Referring to FIG. 2, on each side of the card an approximately semi-circular, rigid side plate 18 is secured laterally to the machine frame (not shown); cast concentrically onto its outer side in the region of the periphery thereof there is a curved, rigid bearing element 19, which has a convex outer surface 19*a* as its support surface and an underside 19*b*. The apparatus according to the invention includes at least one stationary carding device 20' that at both ends has bearing surfaces that lie on the convex outer surface 19*a* of the bearing element (for example, an extension bend). Carding elements 20*a*, 20*b* with clothing strips 20*a*', 20*b*' (carding clothings) are mounted on the undersurface of the stationary carding segment 20'. The reference number 21 denotes the tip circle of the clothings 20*a*', 20*b*'. The cylinder 4 has on its periphery a cylinder clothing 4*a*, for example, a saw tooth clothing. The reference numeral 22 denotes the tip circle of the cylinder clothing 4*a*. The distance between the tip circle 21 and the tip circle 22 is denoted by the letter a, and is, for example, 0.20 mm. The clearance between the convex outer surface 19*a* and the tip circle 22 is denoted by the letter b. The radius of the convex outer surface 19*a* is denoted by $r_1$ and the radius of the tip circle 22 is denoted by $r_2$. The radii $r_1$ and $r_2$ intersect at the mid-point M of the cylinder 4. The carding segment 20' shown in FIG. 2 consists of a support 23 and two carding elements 20*a*, 20*b*, which are arranged in succession in the direction of rotation (arrow 4*b*) of the cylinder 4, the clothings 20*a*', 20*b*' of the carding elements 20*a*, 20*b* and the clothing 4*a* of the cylinder 4 lying facing each other. The carrier body 23 consists of an aluminium hollow profiled member and has continuous hollow spaces.

As shown in FIG. 3, the carding clothing 4*a* (all-steel) and the clothing strips 20*b*' (all-steel) face one another with a clearance a (see FIG. 2). The cylinder clothing 4*a* is connected via an electrical lead 24 and the clothing strip 20*b*' is connected via an electrical lead 25 to a counting device 26. The counting device 26 is able to determine the number of contacts between the card clothing 4*a* and the clothing strip 20*b*' per unit of time. An electrical power source, for example, a battery, is present in the lead 24. The counting device 26 is connected via an electrical lead 28 to a comparator 29, to which furthermore a limit value setter is connected. The comparator 29 is able to compare the number of contacts determined by the counting device 26 with a number of contacts preset in the limit value setter. Finally, the output of the comparator 29 is connected to the input of an electronic control and regulating device, for example, the machine control 31. When a limit for the number of contactings per second is exceeded (see FIG. 4), the card K is switched off by a shutdown device 32. The circuit may additionally include one or both of a device for determining the duration of the contacts, and a device for determining the intensity of the contacts (for example, a resistance-measuring device).

The metal clothings 4*a* and 20*b*' act like a switch in an electric circuit. The battery 27 can produce, for example, a low voltage of 5 V.

Figure 4:
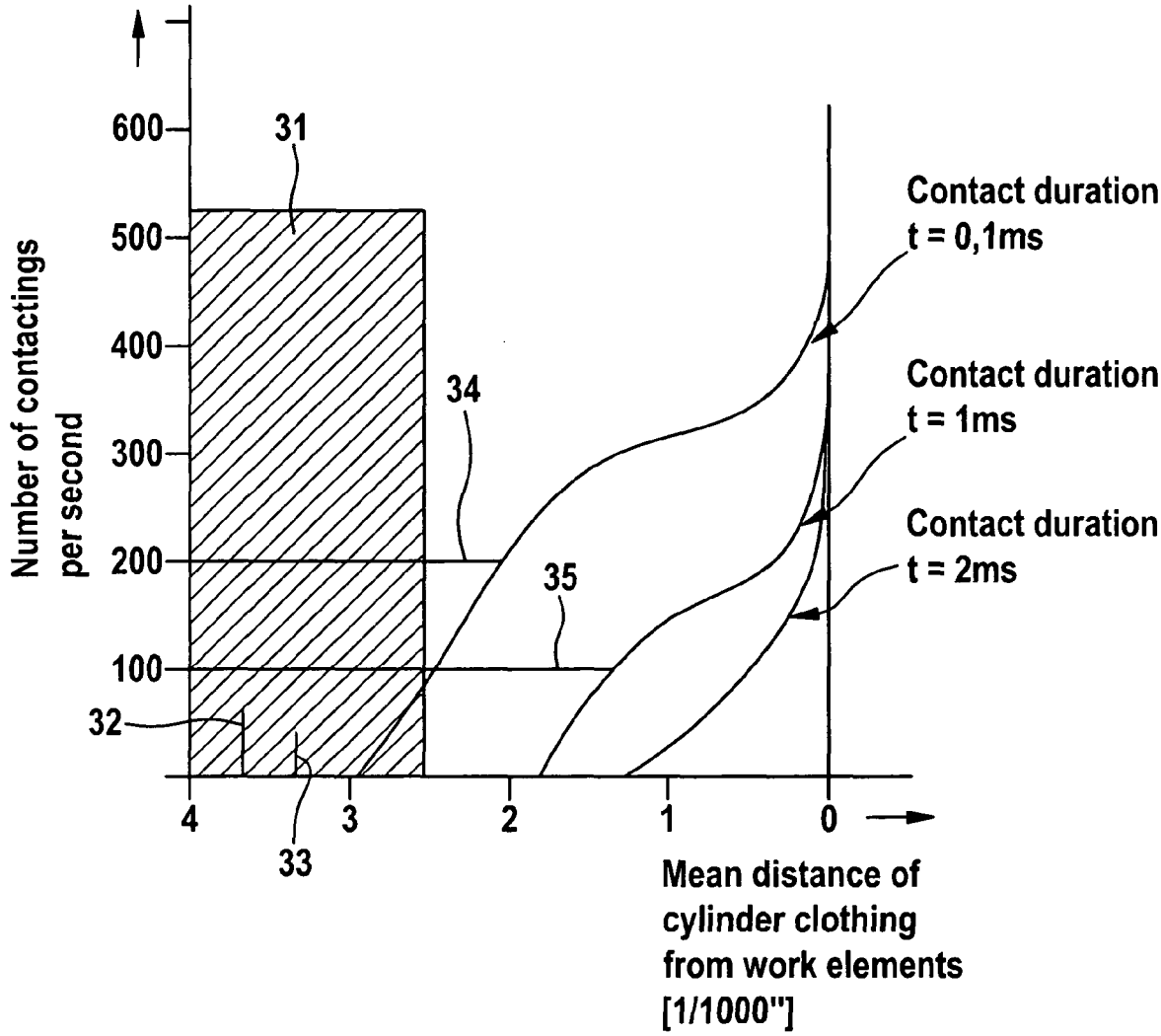
FIG. 4 is a graph of the dependence of the number of contactings per second on the mean distance of the cylinder clothing from the facing work elements.

In FIG. 4, the number of contactings per second is plotted over the mean clearance of the cylinder clothing 4*a* with respect to the work elements, for example, clothing strip 20*b*'. The reference numeral 31 denotes the normal operating range of the machine, for example, the card. The reference numerals 32 and 33 denote sporadic contacts that lie below the shutdown limit, in which case the machine is not shut down. Three curves are shown for the contact duration t=0.1 ms, t=1 ms and t=2 ms. The reference numeral 34 denotes the possible shutdown limit for t=0.1 ms and 35 denotes the possible shutdown limit for t=1 ms.

Figure 5:
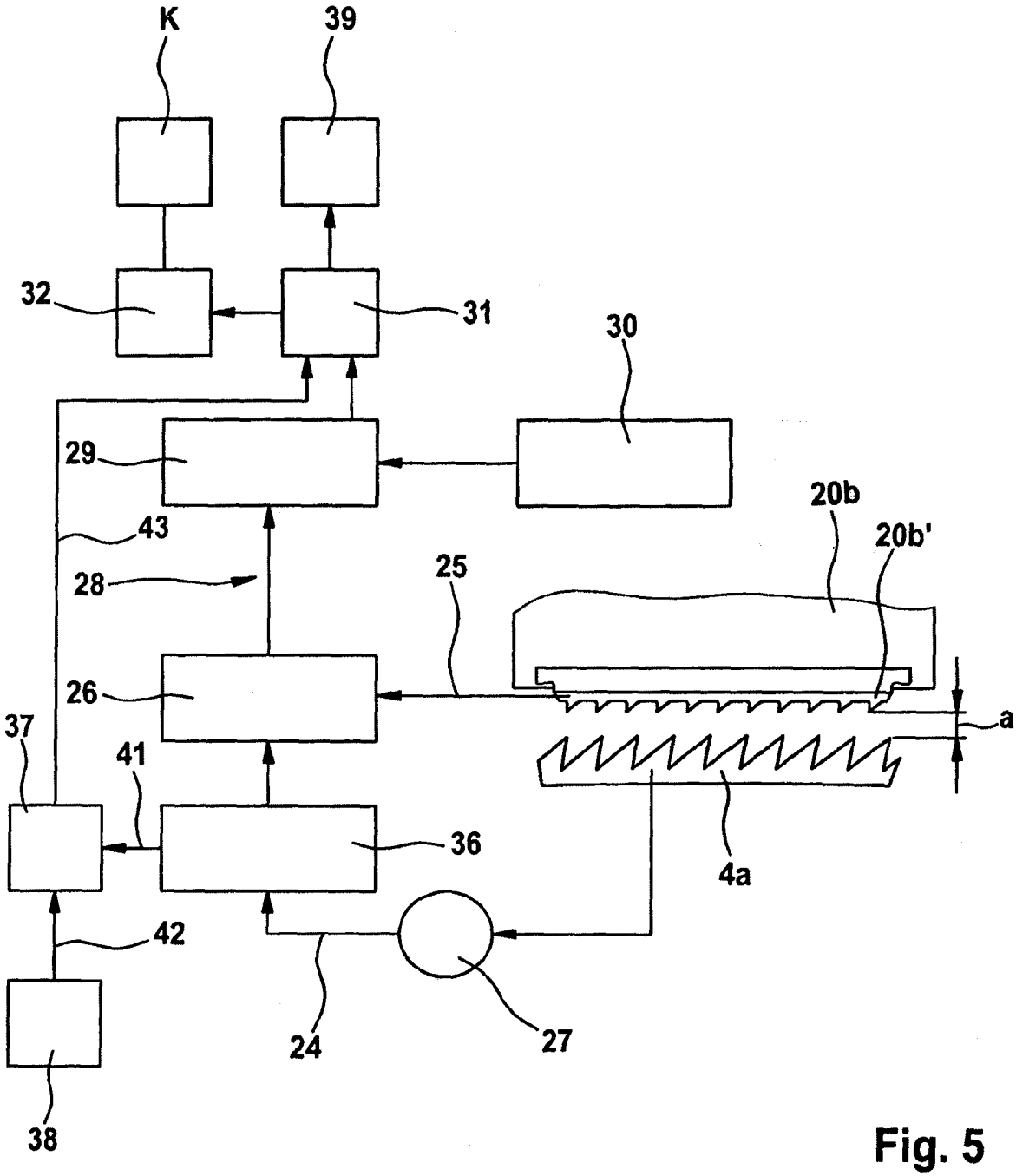
FIG. 5 is a block diagram of an apparatus according to a further embodiment of the invention, including a capacitance-measuring device, a capacitance comparator and a capacitance limit value setter.

In a further exemplary embodiment shown in FIG. 5, the carding clothing 4*a* (all-steel) and the clothing strips 20*b*' (all-steel) face one another with a clearance a. The cylinder clothing 4*a* is connected via an electrical lead 24 and the clothing strip 20*b*' is connected via an electrical lead 25 to a counting device 26. The counting device 26 is able to determine the number of contacts between the card clothing 4*a* and the clothing strip 20*b*' per unit of time. An electrical power source, for example, a battery 27, is present in the lead 24. The counting device 26 is connected via an electrical lead 28 to a contact-comparator 29, to which furthermore a limit value setter 30 is connected. The comparator 29 is able to compare the number of contacts determined by the counting device 26 with a number of contacts preset in the limit value setter 30. The output of the comparator 29 is connected to the input of an electronic control and regulating device, for example, the machine control 31. When a limit for the number of contactings per second is exceeded, the card K is switched off by a shutdown device 32. In those respects, the apparatus corresponds to that of FIG. 3.

The metal clothings 4*a* and 20*b*' act like a switch in an electric circuit. The battery 27 can produce, for example, a low voltage of 5 V.

In the electrical circuit, in the example of FIG. 5 in the lead 24, there is a device for measuring capacitance 36, which is connected via a lead 41 to a capacitance comparator 37 to which furthermore a capacitance limit value setter 38 (desired value setter) is connected via lead 42. The capacitance comparator 37 is able to compare the actual capacitance $C_1$ or $C_{tot}$ measured in the circuit with a preset desired capacitance $C_1$. The output of the capacitance comparator 37 is connected via a lead 43 to the input of the electronic control and regulating device 31. The existence of an interruption in the circuit is indicated by an indicating device 39. Switching off the card K by the shutdown device 32 can also be effected.

Figure 6A:
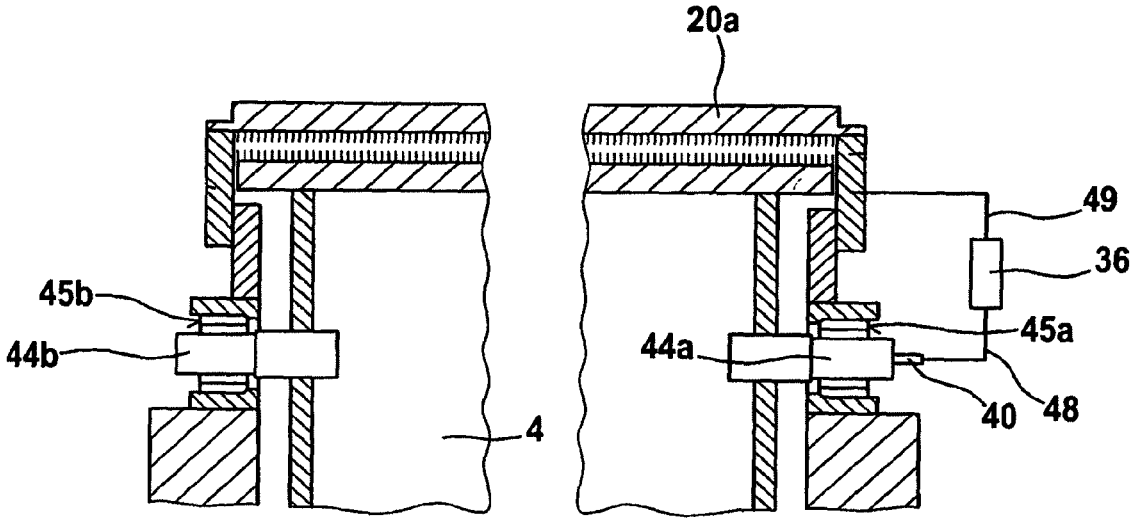
FIGS. 6*a*, 6*b* are partial sections through a carding machine without interruption of the electrical circuit (FIG. 6*a*) and with interruption of the electrical circuit (FIG. 6*b*)
Figure 6B:
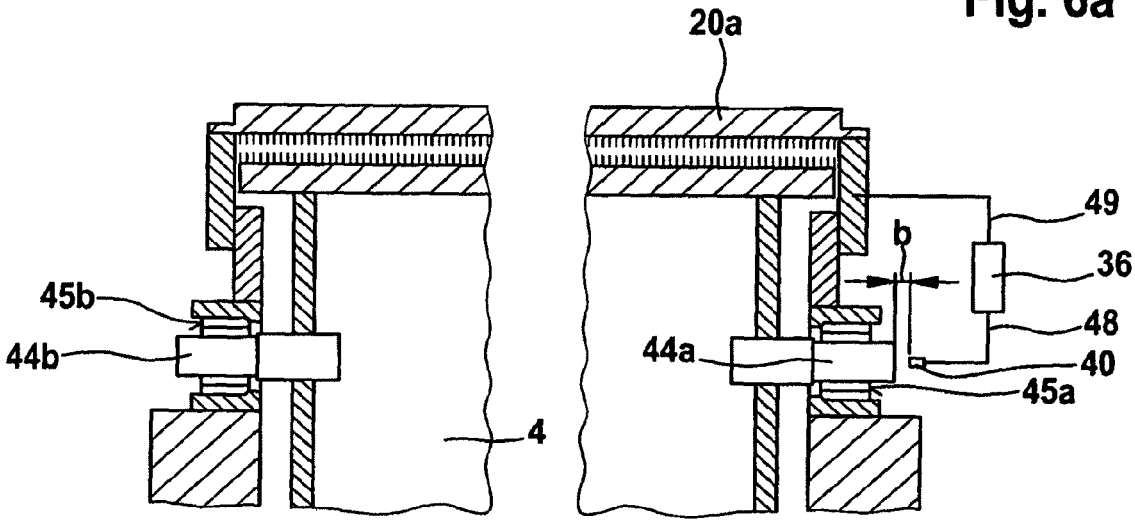

In the embodiment of FIGS. 6*a* and 6*b*, the cylinder is electrically isolated, and a voltage is applied thereto. If the functional elements and the cylinder clothing 4*a* should touch, this is indicated by individual countable contacts. By evaluating the contact number and duration, the machine K can be switched off in good time. Damage to the machine is therefore prevented. Given that the cylinder 4 rotates, the electrical connection is produced via a sliding-action contact (carbon rod 40) centrally in the cylinder journal 44*a*. To safeguard the function of the system (TCM), this electrical connection is tested at regular intervals or continuously (self testing).

In the case of the cylinder 4, the area delimited by cylinder 4 and functional elements (clothing 20*a*', 20*b*') is very large, whereas the clearance a is very small. Accordingly, the capacitance $C_1$ has to assume a very large value (FIG. 6*a*). If contacting is interrupted in a region (FIG. 6*b*), a second plate capacitor is produced at the point of rupture. Considered in electrical terms, a series connection of capacitors is thus produced. In this case, the total capacitance (measured variable) is calculated from the following formula:

$$\frac{1}{C_{tot}} = \frac{1}{C_1} + \frac{1}{C_2}$$

$C_{tot}$—total capacitance (measured variable)

$C_1$—partial capacitance 1 e.g. between cylinder and functional elements $C_2$—partial capacitance 2 at the disturbance point.

The following numerical example serves for further explanation:

In normal operation, i.e. with no interruption of the circuit (FIG. 6*a*), the capacitance between the cylinder 4 and the functional elements equals 1000 owing to the large area. In the event of a fault, i.e. when the circuit is interrupted (FIG. 6*b*), a further capacitance $C_2$ is added in the region of the interrupted electrical connection. This has a very much smaller area, here assumed at a value of 10. If these two values are inserted in the formula for the series connection, then the following is true for the total capacitance:

$$\frac{1}{C_{tot}} = \frac{1}{C_{10}} + \frac{1}{C_{1000}} = 0.101$$

-continued $$C_{tot} = \frac{1}{0.101} = 9.9$$

If the value of the intact system (FIG. 6*a*) of 1000 is compared with that of the defective system (FIG. 6*b*) of 9.9, a clear difference is revealed. Such a difference signifies a malfunction in the system (self testing).

Figure 7A:
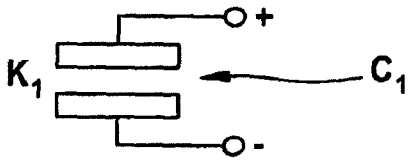
FIGS. 7*a*, 7*b* are schematic representations of the capacitors and the associated capacitances without interruption of the electrical circuit (FIG. 7*a*) and with interruption of the electrical circuit (FIG. 7*b*)
Figure 7B:
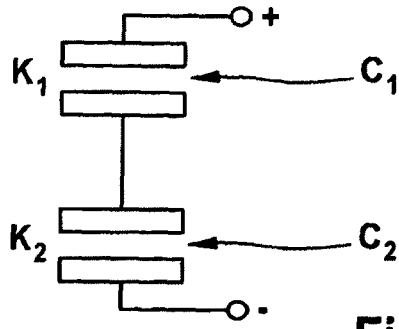

The capacitor $K_1$ illustrated in FIG. 7*a* is determined by the area of the clothings 4*a* and 20*b*' (see FIG. 5), the clearance a thereof and the dielectric constant e. The capacitor $K_1$ (of the capacitance $C_1$) is connected to an electrical power source (symbols "+" and "−"); the electric circuit is not interrupted. According to FIG. 7*b*, added to the capacitor $K_1$ is a second capacitor $K_2$ (of a capacitance $C_2$), which is determined by the end face areas of the carbon rod 40 and the journal 44*a*, by the distance of the carbon rod 40 from the journal 44 (see FIG. 6*b*) and the dielectric constant ∈. A series connection of capacitors $K_1$ and $K_2$ is thus formed.

Figure 8:
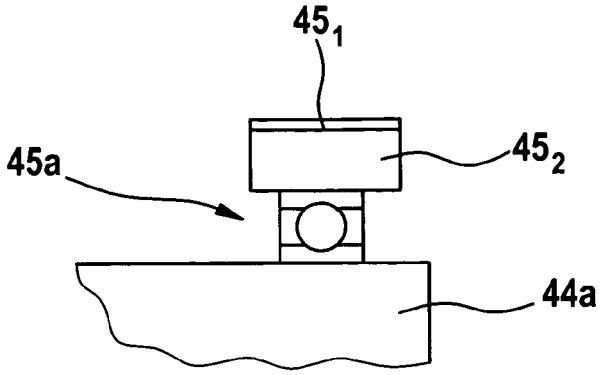
FIG. 8 shows a bearing for the rotatable journals of the cylinder with electrical isolation.

For rotatable mounting of the shaft journals 44*a* and 44*b*, a respective pivot bearing 45*a*, 45*b* is present (see FIGS. 6*a*, 6*b*). In an exemplary arrangement shown in FIG. 8, the pivot bearing 45*a* is mounted in a non-rotatable part $\mathbf{45}_2$ (pot). The part $\mathbf{45}_1$ (insulating element), which engages on the one hand with the stationary side plate that is, the machine frame, and on the other hand with the part $\mathbf{45}_2$, is electrically non-conducting, i.e. an insulator. The part $\mathbf{45}_2$, which engages with each of the conductive bearings 45*a* and 45*b*, is of metal (steel), i.e. is electrically conductive. In this way, the components arranged with clearance are electrically isolated with respect to one another and are connected as contact element to the electrical power source 27.

Figure 9A:
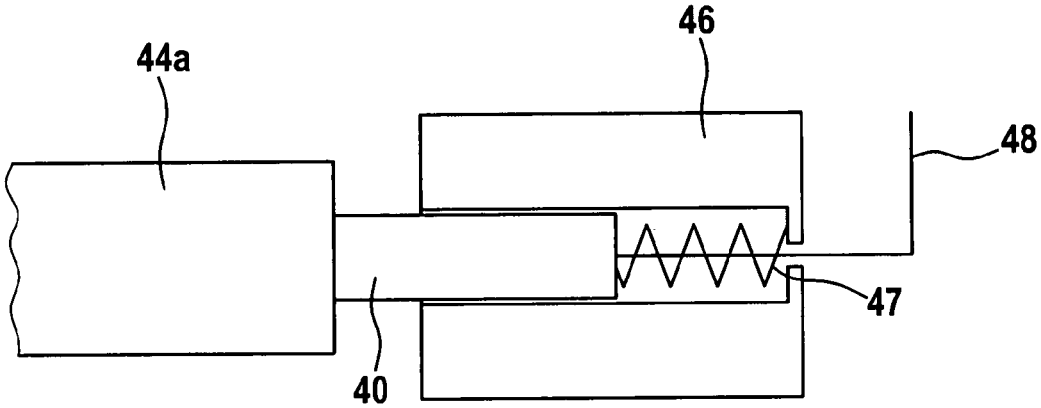
FIGS. 9*a*, 9*b* show an electrical sliding-action contact in engagement with a cylinder journal (FIG. 9*a*) and disengaged from the cylinder journal.
Figure 9B:
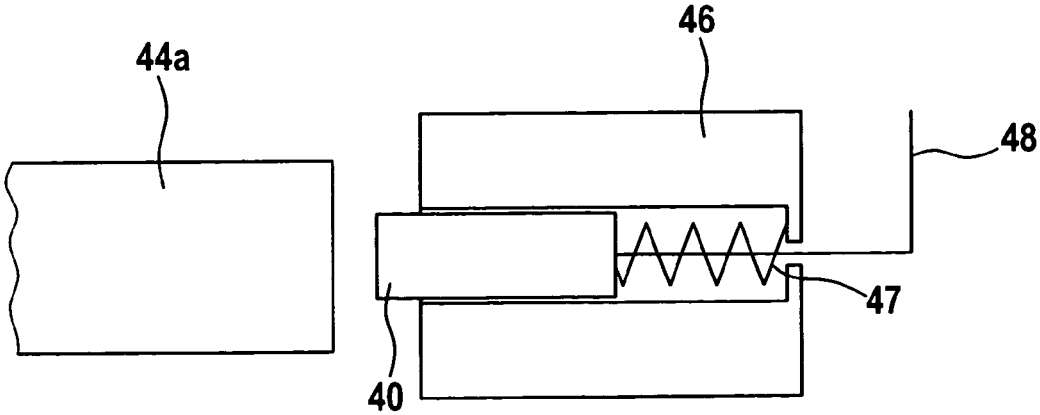

In a further embodiment shown in FIG. 9*a*, one end face of the carbon rod 40 lies at an end face of the rotatable shaft journal 44*a*, whilst the other end face of the carbon pin 40 is loaded by a compression spring 47. The carbon rod 40 is mounted in a hollow-cylindrical holding element 46 so as to move in the axial direction. The reference numeral 48 denotes an electrical lead between the carbon rod 40 and the device for measuring capacitance 36, which is connected via a line 49 to the metal side plate 45*a*, in the manner shown in FIG. 6*b*. The carbon rod 40 is in electrical contact with the shaft journal 44*a*, so that the circuit is closed. If, for example, owing to wear, the carbon rod 40 has a clearance b from the shaft journal 44*a*, the circuit is interrupted, as shown in FIG. 9*b*. At the same time, in addition to the capacitor $K_1$, the further capacitor $K_2$ is thereby formed (see FIG. 7*b*).

The invention has been explained using the example of a stationary component (stationary carding segment 20') on a flat card. The invention also includes other components on a flat card, including non-stationary components, for example, flat bars 14 (revolving flat) and stationary and non-stationary components on other spinning preparation machines, for example stationary carding segments or rotating rollers (worker rollers, clearer rollers) on a roller card or the like.

Although the foregoing invention has been described in detail by way of illustration and example for purposes of understanding, it will be obvious that changes and modifications may be practised within the scope of the appended claims.

What is claimed is:

1. An apparatus on a spinning preparation machine, comprising a clothed roller and a machine component opposed to the clothed roller and defining therewith a clearance at which contact between the roller and opposed component is to be monitored, wherein: said clothed roller and said machine component are electrically isolated with respect to one another at said clearance during normal operation; said clothed roller and said machine component are connected as contact elements to an electrical circuit; and said electrical circuit includes a measuring device for quantitatively measuring the contacts.

2. An apparatus according to claim 1, in which for quantitatively measuring the contacts the measuring device can determine at least one parameter selected from the number of times the roller and opposed component touch each other, the duration of each occasion upon which the roller and opposed component touch each other, the intensity with which the roller and opposed component touch each other, and combinations thereof.

3. An apparatus according to claim 1, in which the quantity of the contacts is directly determinable.

4. An apparatus according to claim 1, in which the quantity of the contacts is indirectly determinable.

5. An apparatus according to claim 1, in which the measuring device comprises a device for determining the number of contacts.

6. An apparatus according to claim 1, in which the intensity of the contacts is determinable.

7. An apparatus according to claim 6, comprising a resistance-measuring device for determining the intensity of the contacts.

8. An apparatus according to claim 1, in which the quantity of the contact per unit of time is determinable.

9. An apparatus according to claim 1, in which the roller and the opposed component have electrically conductive clothings which are electrically connected to the device for quantitatively determining the contacts.

10. An apparatus according to claim 1, in which the device for quantitatively determining the contacts comprises a comparator and a limit value setter.

11. An apparatus according to claim 1, in which an electrical signal is generated upon a contact between the roller and a facing component.

12. An apparatus according to claim 1, which is connected to one or more devices selected from the group consisting of a signalling device, an alarm device, and a shutdown device for the card.

13. An apparatus according to claim 1, in which the measuring device is connected to a control system for the machine and the clearance to be monitored is adjustable by an adjusting device connected to the control system, in dependence upon the quantitatively determined contacts.

14. An apparatus according to claim 1, in which the measuring device comprises a device for measuring the duration of the contacts.

15. An apparatus on a spinning preparation machine for monitoring or adjusting clearances, comprising:

a clothed, high-speed roller located facing at least one clothed and/or unclothed component, wherein clearance between the roller and the component facing one another is alterable, the roller and the component being electrically isolated with respect to one another and connected as contact elements to an electrical power supply line in which a measuring device for ascertaining contact is located, wherein upon contacts of the component with clothing of the roller, electrical signals are emitted and the measuring device includes a device for determining a quantity of the contacts.

16. A spinning preparation machine comprising one or more clearances to be monitored, each clearance being defined between a clothed roller and a respective opposed machine component wherein, at the or each said clearance: said clothed roller and opposed machine component forming said clearance are electrically isolated with respect to one another during normal operation; said clothed roller and opposed machine component are connected as contact elements to an electrical circuit; and said electrical circuit includes a measuring device for quantitatively measuring the contacts.

17. An apparatus according to claim 1, in which the electrical capacitance between the components facing one another at a clearance is determinable and, upon variation from a set capacitance, an indicating operation and/or switching operation is initiated.

18. An Apparatus according to claim 17, in which the apparatus is used to monitor for an interruption in the electrical circuit.

19. An apparatus according to claim 17, in which the wear of a non-rotating component is monitored.

20. An apparatus according to claim 18, in which the apparatus is arranged to monitor for interruption of a contact between an electrical lead and a component.

21. An apparatus according to claim 17, the apparatus including a capacitance measuring device comprising a capacitance comparator and a capacitance limit value setter.

22. An apparatus according to claim 1, which further comprises as an electrical power source a battery.

23. An apparatus according to claim 1, which further comprises an electrical power source for generating a voltage of not more than 20V.

24. A method of monitoring the clearance between a clothed roller of a textile machine and an opposed component, at least one of said clothed roller and said opposed component defining the clearance to be monitored being connected to an electrical power supply, comprising: operating the textile machine; maintaining said clothed roller and said opposed component in electrical isolation from one another; on the or each occasion upon which the clothing of the roller touches the opposed component, monitoring the electrical contact arising from the touching of the roller clothing and the opposed component; and quantitatively determining therefrom the extent to which the roller clothing and the opposed component touch each other.

25. A method according to claim 24, in which there is determined a cumulative value for the extent to which the roller clothing and the opposed component touch each other, the cumulative value comprising one or more of the number, the duration and the intensity with which the roller clothing and the opposed component touch each other.

* * * * *